United States Patent [19]

Walker

[11] 3,934,723

[45] Jan. 27, 1976

[54] LIGHT BULB CONTAINER

[75] Inventor: Stephen F. Walker, Denver, Colo.

[73] Assignee: Alan P. McGregor, Denver, Colo.

[22] Filed: Nov. 18, 1974

[21] Appl. No.: 518,690

[52] U.S. Cl. ..... 206/422; 229/2.5; 229/44 R

[51] Int. Cl.[2] ..... B65D 1/00; B65D 85/42

[58] Field of Search ..... 206/418–420, 206/422, 521, 523; 229/2.5, 39 B, 44 R, 44 EC, 45 EC, 29 M

[56] References Cited

UNITED STATES PATENTS

| | | | |
|---|---|---|---|
| 2,428,384 | 10/1947 | Randall | 206/422 |
| 2,569,733 | 10/1951 | Ringler | 206/422 X |
| 3,664,574 | 5/1972 | Pearl et al. | 229/45 EC X |
| 3,674,168 | 7/1972 | Padovani | 229/2.5 X |
| D142,116 | 8/1945 | Parsons et al. | 229/29 M |
| D142,117 | 8/1945 | Parsons et al. | 229/29 M |
| D142,129 | 8/1945 | Shepard | 229/29 M |

*Primary Examiner*—William Price
*Assistant Examiner*—Steven E. Lipman
*Attorney, Agent, or Firm*—Burton, Crandell & Polumbus

[57] ABSTRACT

A light bulb container is made of a plastic foam material and includes a lower open topped receptacle portion with a downwardly opening top member pivotally connected to the receptacle portion along one edge thereof. The receptacle portion has a raised partition therein defining areas in which light bulbs can be received. The partition has a horizontal cross section defined by two continuous arcuate sections having their centers on opposite sides of the partition so that the partition continuously engages each light bulb in the container to prevent damage to the bulbs either from external or internal sources.

6 Claims, 6 Drawing Figures

LIGHT BULB CONTAINER

BACKGROUND OF THE INVENTION

The present invention relates generally to box-type containers and more particularly to a box-type container designed to retain light bulbs in a protected manner.

Containers for light bulbs have not changed appreciably for numerous years and accordingly have not been updated to take advantage of modern day containerizing techniques. More particularly, plastic and particularly plastic foams have recently been used to containerize articles such as eggs or the like and due to the mass production capabilities of plastic molding, the containers can be manufactured in an economical manner.

Since light bulbs have a unique configuration and are also extremely fragile, it is difficult to design a container, particularly out of a plastic material, which will suitably cushion the bulb, protect it from outside forces and provide the necessary dividing means within the container for separating a plurality of bulbs since light bulbs are frequently marketed with more than one bulb per package.

OBJECTS OF THE INVENTION

It is an object of the present invention to provide a new and improved container for light bulbs which can be manufactured on a mass production basis without detrimentally affecting the utilitarian function of the container.

It is another object of the present invention to provide a new and improved light bulb box made of a plastic foam material and adapted to reliably retain a plurality of light bulbs in isolated relationship to prevent damage to the bulbs.

It is another object of the present invention to provide a new and improved light bulb box wherein the light bulbs are separated by divider means which lie in continuous engagement with a portion of the light bulb to prevent movement of the one bulb in the box into engagement with another bulb in the box.

It is another object of the present invention to provide a light bulb box which is designed to adequately protect light bulbs stored in the box and which can be nested when empty for convenience in storage.

Other objects, advantages and capabilites of the present invention will become more apparent as the description proceeds taken in conjunction with the accompanying drawings.

SUMMARY OF THE INVENTION

The light bulb container of the present invention is designed to be mass produced in an economical manner and to adequately protect light bulbs during normal handling of the containers.

The light bulb box includes a lower receptacle portion having an open top and a raised divider extending upwardly from the bottom of the receptacle to separate the receptacle into two light bulb receiving areas. The partition is uniquely designed to follow the contour of each light bulb so that it lies in continuous engagement with the light bulb and thereby prevents one light bulb from moving within the container into engagement with another light bulb. As is well known, light bulbs have a metallic contact portion at their lower end which is capable of breaking the glass of another light bulb if allowed to engage the glass portion of the other bulb with any force. With the design of the partition of the light bulb box of the present invention, it is physically impossible for the metallic contact portion of one bulb to pass over the partition and engage the glass portion of the other bulb when the box is closed.

The light bulb box has a top member which is hinged along one edge to the receptacle portion of the box and includes a latch to releasably secure it in a closed position over the top of the receptacle. The receptacle portion of the box has downwardly convergent walls and the partition opens through the bottom of the box so that empty boxes can be nested in stacked relationship to save space when the boxes are in storage.

DESCRIPTION OF THE PREFERRED EMBODIMENT

Figure 1:
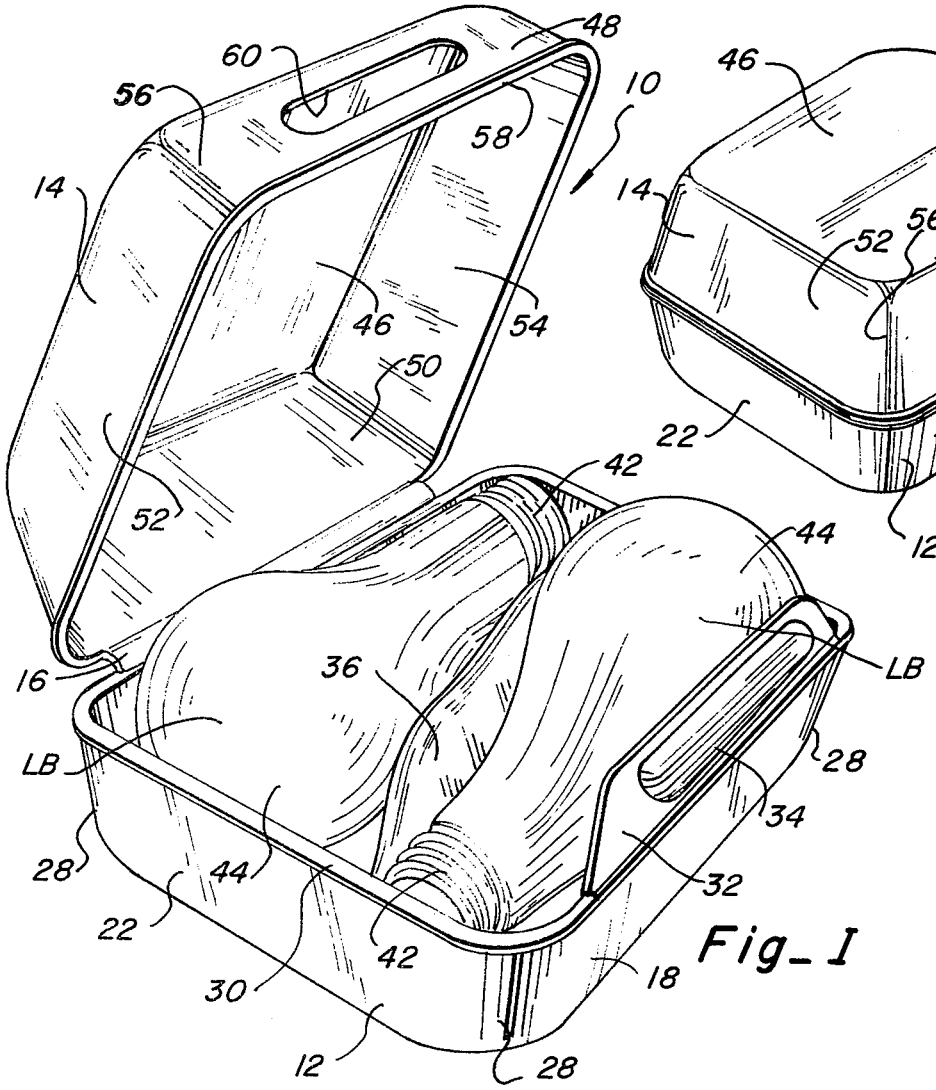
FIG. 1 is perspective view of the light bulb container of the present invention in an open condition with light bulbs received therein.

Referring first to FIG. 1, the light bulb container or box 10 of the present invention can be seen to include a lower receptacle portion 12 and a top member 14 which is connected to the receptacle portion by a hinge member 16 extending along the rear edge of the top member and receptacle portion. In the preferred form, the box 10 is made of a polystyrene foam material and the hinge 16 takes the form of an integral living hinge.

Figure 5:
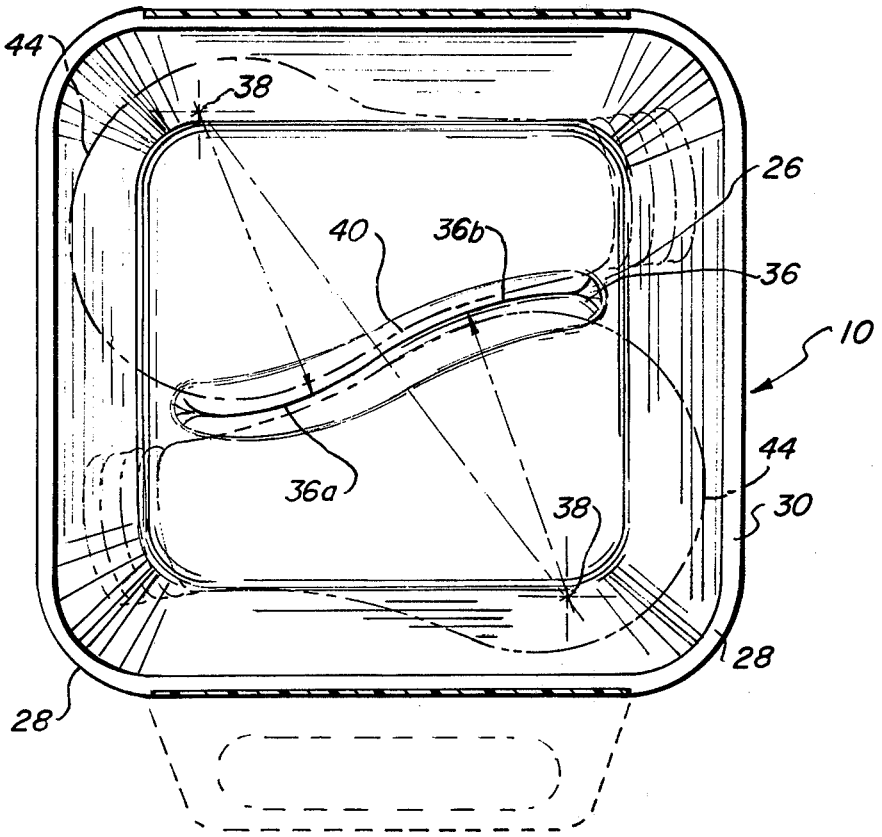
FIG. 5 is a horizontal section taken along line 5—5 of FIG. 1.

The receptacle portion 12 as can be seen in FIG. 5, is of quadrangular horizontal cross sectional configuration having a front wall 18, a rear wall 20, each preferably forming a 20° angle with vertical so as to be downwardly convergent with each other, left and right side walls 22 and 24 respectively, each preferably forming a 20° angle with vertical so as to be downwardly convergent with each other, and a bottom wall 26. Each corner 28 of the receptacle is rounded so that a continuous flange 30 is established around the top perimeter of the receptacle 12 as defined by the top edges of the front, rear and side walls. The flange 30 protrudes outwardly and has a flat upper surface.

An upwardly extending tab 32 of generally trapizoidal configuration is integrally and hingedly connected to the flange 30 along the front wall of the receptacle and has a forwardly protruding horizontally extending elongated bead 34 formed therein. The tab 32 forms one part of a releasable latch which will be further described later.

Figure 6:
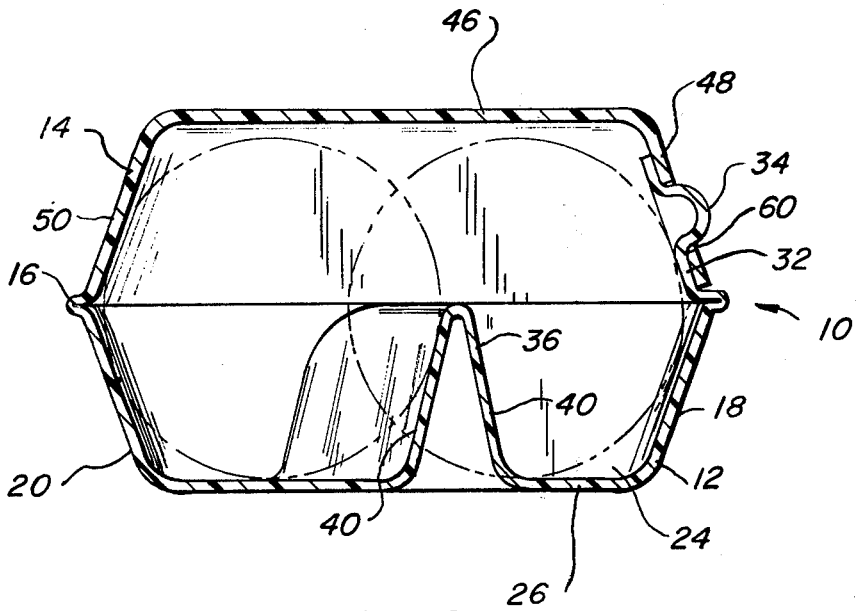
FIG. 6 is a vertical section taken along line 6—6 of FIG. 4.

As best seen in FIGS. 1, 5, and 6, a raised partition 36 on the bottom wall 26 of the receptacle extends generally in the same direction as the front and rear walls of the receptacle. The uppermost edge 37 of the partition 36 has a horizontal cross sectional configuration defined by two continuous arcuate portions **36*a* and 36*b* of equal radius having their centers 38 on opposite sides of the partition. In the preferred form, to handle most standard light bulbs, the radius of each arcuate portion 36***a* and 36*b* is approximately 2 inches. The configuration of the partition is such that it continuously engages the sides of light bulbs LB retained in the receptacle along a majority of the length of the bulbs as best illustrated in FIG. 5. The partition has upwardly convergent sides 40, has its ends terminating slightly short of the side ends of the bottom wall, and opens downwardly through the bottom of the receptacle. It will be appreciated, that with this design, a plurality of identical light bulb boxes 10 can be nested when the top members 14 of the boxes are in an open condition. This of course saves valuable storage space when the boxes are not in use.

The upperward inclination of the sides 40 of the partition is not uniform but rather increases from one end of the partition to the other. One side 40 of the partition is steepest at the end of the partition where the other side 40 is the least steep. The varying slope of the sides 40 of the partition allows the partition to lie in continuous engagement with a light bulb LB when the top and bottom ends of the bulb are engaging opposite side walls 22 and 24 of the receptacle.

As is best illustrated in FIGS. 1, 5, and 6, the partition 36 divides the receptacle portion of the box into two light bulb receiving areas on opposite sides of the partition in which light bulbs LB can be firmly received for desirable packaging purposes. In other words, a light bulb positioned in one of the light bulb receiving areas of the box will engage the bottom wall 26 of the box and will be gripped between the front wall 18 and the partition 36 in a lateral direction, and between the opposite side walls 22 and 24 in a longitudinal direction to positively position the light bulb within the box. Since the partition is in continuous engagement with the side of the light bulb along an intermediate portion of the bulb and along a majority of the length of the light bulb, movement of the metallic contact end 42 of the light bulb in a substantially vertical direction will be allowed to a limited extent due to the reduced size of the metallic contact end of the bulb relative to its opposite enlarged glass end 44 but the partition will not allow the contact end of the bulb to pass thereacross when the top member 14 of the box is closed and accordingly, the contact end of one bulb cannot engage the other light bulb in the box and cause damage thereto when the box is closed.

Accordingly, when the top of the box is closed, each bulb is tightly retained within the area provided therefor and is not allowed to shift enough to cause damage either to itself or to an adjacent bulb in the box. This limitation on the movement of the light bulbs within the box is accomplished, even though the partition 36 extends only to the height of the receptacle portion 12 of the box, principally due to the fact that the partition continuously engages the side of each light bulb and positively restricts its movement.

The top member 14 of the box 10 is practically a mirror image of the receptacle portion 12 and has a top wall 46, front and rear walls, 48 and 50 respectively, which preferably form a 20° angle with vertical and are upwardly convergent with each other, and left and right side walls 52 and 54 respectively which also form a 20° angle with vertical and are upwardly convergent with each other. Each corner 56 of the top member is rounded and a continuous flange 58 is provided along the lower perimeter of the top member. The flange 58 has a flattened lower surface which is adapted to abut the flat surface of the flange 30 on the receptacle portion when the box is closed.

Figure 2:
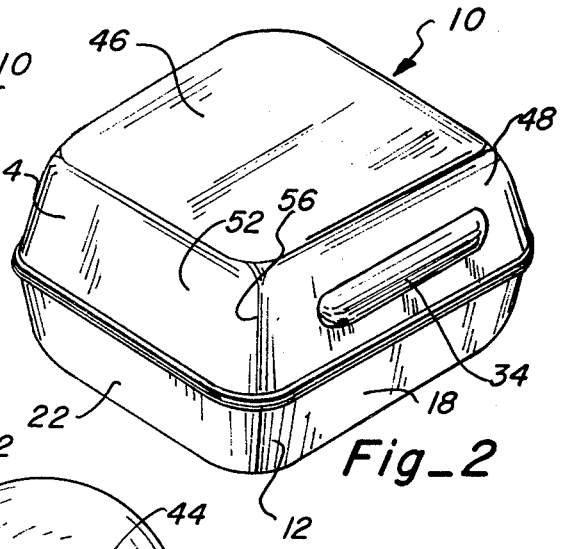
FIG. 2 is a perspective view of the light bulb container of FIG. 1 in a closed position.
Figure 3:
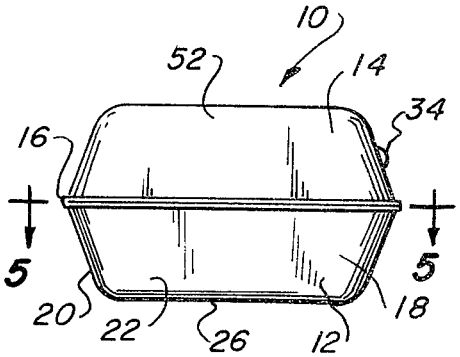
FIG. 3 is a side elevation of the light bulb container as shown in FIG. 2.
Figure 4:
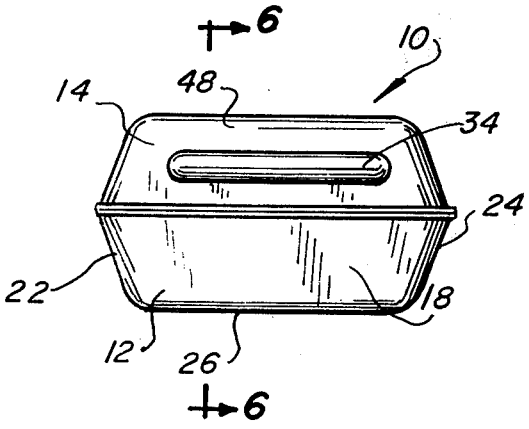
FIG. 4 is a front elevation of the light bulb container as shown in FIG. 2.

To selectively retain the box in the closed condition of FIGS. 2 through 4, the front wall 48 of the top member 14 is provided with an elongated opening 60 conforming in configuration to the forwardly projecting bead 34 on the tab 32 of the receptacle 12 and is of slightly smaller dimension so as to frictionally grip the bead when the bead is inserted thereinto. The frictional grip serves to releasably retain the top member in a closed condition such that slight digital pressure applied to the bead will force the bead in an inward pivotal direction to release it from the opening and thereby allow the top member to be swung to its open condition of FIG. 1.

It will be appreciated that a light bulb box has been described which is simple in construction, can be readily molded out of plastic foam material in a mass production manner and yet retain light bulbs in a safe and reliable manner so that they will not be damaged by external forces applied to the box during normal handling. The light bulbs are also more readily accessible than in presently used light bulb boxes wherein the bulbs are retained in corrugated sleeves which are slid within other retaining members to retain the bulb in the desired position. The plastic box-like construction of the present invention further provides more adequate protection against external forces than currently used corrugated paper boxes.

Although the present invention has been described with a certain degree of particularity, it is understood that the present disclosure has been made by way of example and that changes in details of structure may be made without departing from the spirit thereof.

What is claimed is:

1. A nestable container for light bulbs, said container comprising in combination:

an open-topped receptacle of quadrangular horizontal cross-section having bottom and side walls, said receptacle side walls forming an angle with vertical so as to be downwardly convergent, a top member adapted to lie over the open top of said receptacle, said top member having a top wall and side walls, said top member side walls forming an angle with vertical so as to be upwardly convergent, a raised partition formed in said bottom wall of said receptacle having upwardly convergent sides defining an uppermost edge and opening downwardly to the bottom of said receptacle for defining separate light bulb receiving areas, said partition being generally S-shaped so that light bulbs placed in adjacent receiving areas are diametrically opposed, said uppermost edge of said partition extending to the height of said receptacle, tapering downwardly into ends level with said bottom wall, and terminating slightly short of the side ends of said bottom wall so that said light bulb positioned in one of said receiving areas engages said partition along the intermediate portion of said light bulb, means for hinging said top member to said receptacle along the corresponding rear side walls of said receptacle and said top member, and means for releasably connecting said top member with said receptacle along the front side walls of said container so that when said top member is connected to said receptacle the enlarged glass end of said light bulb frictionally engages said top wall, said bottom wall, and two side walls of said receptacle and the metallic contact end of said light bulb frictionally engages said bottom wall and one side wall of said receptacle.

2. The container of claim 1 wherein each corner of said receptacle is rounded and said container further comprises a continuous flange around the top perimeter of said receptacle and a continuous flange around the bottom perimeter of said top member so that when said top member covers said receptacle the abovesaid two flanges abut and protrude outwardly from said container encircling the mid-section of said container.

3. The container of claim 2 wherein said releasable connecting means comprises:

an upwardly extending tab of generally trapezoidal configuration integrally and hingedly connected to said flange of said receptacle on said front wall, a forwardly protruding horizontally extending elongated bead formed along the longitudinal center axis of said tab, and an elongated opening conforming to the configuration of said bead in said front wall of said top member so that said bead engages said opening when said top member covers said receptacle.

4. The container of claim 3 wherein said container is formed from molded plastic.

5. The container of claim 1 wherein said top of said partition defines two continuous accurate portions of equal radius having their centers in opposing receiving areas, one side of each portion having a steep slope conforming to the surface of said enlarged glass end of said light bulb, and the opposite side of each portion having a shallow slope conforming to the surface of the contact end of said light bulb.

6. The container of claim 5 wherein said bottom wall is substantially flat and wherein the said partition opens upwardly in a narrow channel from said bottom wall, said channel being defined by the sides of said partition.

* * * * *